US011365559B2

(12) United States Patent
Chen

(10) Patent No.: US 11,365,559 B2
(45) Date of Patent: Jun. 21, 2022

(54) LOCKING MECHANISM AND DOOR OPENING CONTROL METHOD

(71) Applicant: PANASONIC APPLIANCES MICROWAVE OVEN (SHANGHAI) CHINA CO., LTD., Shanghai (CN)

(72) Inventor: Zeng Chen, Shanghai (CN)

(73) Assignee: PANASONIC APPLIANCES MICROWAVE OVEN (SHANGHAI) CHINA CO., LTD., Shanghai (CN)

( * ) Notice: Subject to any disclaimer, the term of this patent is extended or adjusted under 35 U.S.C. 154(b) by 780 days.

(21) Appl. No.: 16/259,212

(22) Filed: Jan. 28, 2019

(65) Prior Publication Data

US 2019/0234109 A1 Aug. 1, 2019

(30) Foreign Application Priority Data

Jan. 29, 2018 (CN) ..... 201810083947.1

(51) Int. Cl.
*E05B 47/00* (2006.01)
*F24C 15/02* (2006.01)

(52) U.S. Cl.
CPC ..... *E05B 47/0002* (2013.01); *F24C 15/022* (2013.01)

(58) Field of Classification Search
CPC ..... E05B 47/0002; E05B 47/0004; F24C 15/022; F24C 15/02; H05B 6/6417; H05B 6/6414; H05B 6/6435; Y10S 292/69; Y10S 292/04; E05C 19/166
See application file for complete search history.

(56) References Cited

U.S. PATENT DOCUMENTS 3,659,068 A * 4/1972 Duffner ..... H05B 6/6417 219/724
3,784,776 A * 1/1974 Asanuma ..... H05B 6/6417 219/724
3,823,294 A * 7/1974 Takayama ..... H05B 6/6417 219/724
3,967,088 A * 6/1976 Horiuchi ..... H05B 6/6417 219/723
4,006,121 A * 2/1977 Isono ..... E05C 19/024 200/61.64
4,101,750 A * 7/1978 Doner ..... H05B 6/6417 126/197
4,345,144 A * 8/1982 Bergquist ..... F24C 15/022 126/197

(Continued)

*Primary Examiner* — Mark A Williams
(74) *Attorney, Agent, or Firm* — David D. Brush; Westman, Champlin & Koehler, P.A.

(57) ABSTRACT

A locking mechanism and a door opening control method are provided for household appliances. The locking mechanism is provided on a front door panel of a door of a cooking machine and used for controlling the opening and closing of the door and includes: a lever which is mounted on the back surface of the front door panel and at least a portion of which protrudes from an opening provided on the front door panel to the front surface of the front door panel; an electromagnet which is mounted on the back surface of the front door panel and may be in a locked or unlocked state with respect to the lever. The locking of the door of the cooking machine may be realized through the cooperation between the electromagnet and the lever. Real-time control of the door may be realized to better ensure safety of the user.

7 Claims, 7 Drawing Sheets

(56) References Cited

U.S. PATENT DOCUMENTS

| | | | | |
|---|---|---|---|---|
| 4,450,335 | A * | 5/1984 | Shimizu | H05B 6/6417 219/714 |
| 4,638,137 | A * | 1/1987 | Kazumi | H05B 6/6435 219/723 |
| 9,832,820 | B2 * | 11/2017 | Darney | E05B 47/026 |
| 2013/0000203 | A1 * | 1/2013 | Platt | E05D 11/00 49/246 |
| 2017/0067270 | A1 * | 3/2017 | Lang | D06F 37/42 |

* cited by examiner

LOCKING MECHANISM AND DOOR OPENING CONTROL METHOD

CROSS-REFERENCE TO RELATED APPLICATION

The application claims the priority of Chinese Patent Application No. 201810083947.1, filed on 29 Jan. 2018, entitled "LOCKING MECHANISM AND DOOR OPENING CONTROL METHOD".

TECHNICAL FIELD

The present invention relates to the field of household appliances, and in particular to a locking mechanism and a door opening control method.

BACKGROUND ART

With the development of modern science and technology, cooking machines such as a microwave oven and an oven affect people's life style more deeply and raise living standard so as to make life more convenient.

With the development of heating technology, the technology of high-temperature heating of a cooking machine such as a microwave oven has become increasingly mature. The temperature of processed food and utensils is also getting higher and higher, and if a person takes out the food without protection, he or she may be scalded easily.

In the prior art, a button-press type door opening structure of the cooking machine usually includes a front door panel and a button provided on the front door panel. The button usually includes a keycap and a push rod connected to the keycap, wherein the push rod penetrates into a push hole provided on the front door panel and is used to push a door opening lever mounted behind the push hole. The pushed door opening lever may drive and open the door of the cooking machine.

However, in the prior art, there is no locking structure for locking the door opening structure of the cooking machine. In the prior art, since there are few cooking machines that separate a door opening button that children may easily touch, when the cooking machine is in operation, children may easily open the door of the cooking machine and touch the food or utensils during or after heating because of their curiosity, and the children have a high risk of being scalded by food or utensils.

SUMMARY

In order to solve the above-described technical problem, the present invention provides a locking mechanism and a door opening control method which have high reliability and practicability.

The locking mechanism of the present invention is provided on a front door panel of a door of a cooking machine and used for controlling opening and closing of the door, and the locking mechanism includes:

a lever which is mounted on the back surface of the front door panel and at least a portion of which protrudes from an opening provided on the front door panel to the front surface of the front door panel; and an electromagnet which is mounted on the back surface of the front door panel and may be in a locked or unlocked state with respect to the lever.

Compared with the prior art, the present invention achieves the locking of the door of the cooking machine through the cooperation between the electromagnet and the lever. When the locking mechanism is in the locked state, the lever is prevented from moving by the electromagnet, so that a door opening member cannot be triggered by the lever and the door of the cooking machine is locked. When the locking mechanism is in the unlocked state, the door opening operation may be normally performed. In addition, the invention is simple in structure, and thus has good generality and high reliability.

The present invention also provides a cooking machine, wherein the above-described locking mechanism is provided on the cooking machine, and a control panel is provided on the front door panel of the door of the cooking machine.

Compared with the prior art, the cooking machine provided by the present invention achieves the locking of door of the cooking machine through providing the locking mechanism. After the cooking machine finishes the operation, the locking mechanism is unlocked so as to open the door of the cooking machine. The risk of children being scalded when children open the door of the cooking machine is lowered in a way of locking the door by the locking mechanism.

The present invention also provides a door opening control method for performing door opening and closing control on the door of the cooking machine. When the cooking machine is in an operation state, the locking mechanism keeps the door in the locked state, and after the operation of the cooking machine is completed, the locking mechanism keeps the door in the unlocked state.

Compared with the prior art, through the door opening control method provided by the present invention, the electromagnet may be energized to control the locking of the door when the cooking machine is in operation, and the electromagnet may be de-energized to control the unlocking of the locking mechanism after the cooking machine finishes the operation. Through the door opening control method provided by the present invention, the real-time control of the door may be realized so as to better ensure the safety of the user.

Preferably, the locking mechanism further includes a lever mounting plate, wherein the lever mounting plate is provided opposite to the lever across the front door panel, and the lever may be rotatably mounted on the lever mounting plate.

The lever is fixedly mounted on the front door panel by the lever mounting plate. Moreover, the lever may be fixed by the lever mounting plate, and the lever may rotate around a fixed axis to trigger the door opening member and control the opening of the door of the cooking machine.

Further, preferably, the portion of the lever that protrudes from an opening provided on the front door panel includes a protruding part and a pressing part, a pin shaft is formed on the protruding part, and a through hole through which the pin shaft is inserted is provided on the lever mounting plate.

The protruding part protrudes from the opening provided on the front door panel and is rotatably fixed to the lever mounting plate through the pin shaft. The pressing part is used to transfer torque. When a pressure acts on the pressing part, the pressing part is pressed, and since the protruding part of the lever is hinged to the lever mounting plate through the pin shaft, the lever is rotated around a fixed axis and the door opening member is triggered. Moreover, the embedded mounting mode reduces the space required for the locking mechanism, so that the electromagnet and the lever are attached more tightly.

In addition, preferably, one end of the electromagnet is provided with a telescopic push rod, and a portion of the lever close to the push rod is provided with a hole that allows the push rod to be inserted therein.

The electromagnet may control the telescopic push rod. When the push rod is inserted into the hole, the fixed-axis rotation of the lever may be blocked and the pressing part cannot be pressed, so that the door opening member is prevented from being triggered and the door is locked. The lever may normally trigger the door opening member when the push rod is withdrawn from the hole.

Further, preferably, the push rod protrudes from the electromagnet and is inserted into the hole when the electromagnet is turned on; the push rod is retracted from the hole when the electromagnet is turned off.

The telescopic movement of the push rod is flexibly controlled through the electromagnet. The electromagnet generates magnetism under the action of the current and controls the insertion of the push rod into the hole, and when the electromagnet is de-energized, the magnetism of the electromagnet disappears and the push rod is retracted from the hole so as to realize locking or unlocking of the door.

In addition, preferably, the front door panel is provided with a first positioning threaded hole, and the electromagnet is provided with a second positioning threaded hole corresponding to the first positioning threaded hole.

A threaded member is passed through and fixed to the first positioning threaded hole and the second positioning threaded hole, so that the electromagnet is fixed to the front door panel.

The electromagnet may be more firmly positioned and fixed to the front door panel through the threaded member and the positioning threaded hole. When the locking mechanism is locked, the push rod may be firmly inserted in the hole even if the pressing portion is pressed, so that a good locking effect is achieved.

In addition, preferably, the locking mechanism is triggered through pressing a single button or a button combination, so that the door is kept in a locked or an unlocked state.

Locking or unlocking by pressing a single button or a button combination makes the control of the door by the locking mechanism more effective, increases the difficulty for children to unlock and open the door, and may keep the door in the locked state and lower the risk of children being scalded. In addition, the locking mechanism is controlled by the existing button combination, and there is no need to additionally provide a button for controlling the locking mechanism to be locked or unlocked, so that the size of the control panel may be properly controlled and the overall size of the cooking machine may be controlled.

Further, preferably, in the steps of pressing a combination of different buttons, the time interval between the actions of pressing different buttons in the button combination is within a specified range.

In the process of pressing different buttons in the button combination, a specified range of the time interval between two adjacent pressing operations is set, when a user presses each button in the button combination, the effect of controlling the locking mechanism may be achieved only by pressing the buttons within a predetermined time interval, and if the user does not press the buttons within the specified time duration, determination will be performed according to different situations, so that the possibility that the locking mechanism is unlocked or locked due to the erroneous operation of the user may be effectively reduced.

DESCRIPTION OF REFERENCE NUMERALS IN ATTACHED DRAWINGS

Figure 1:
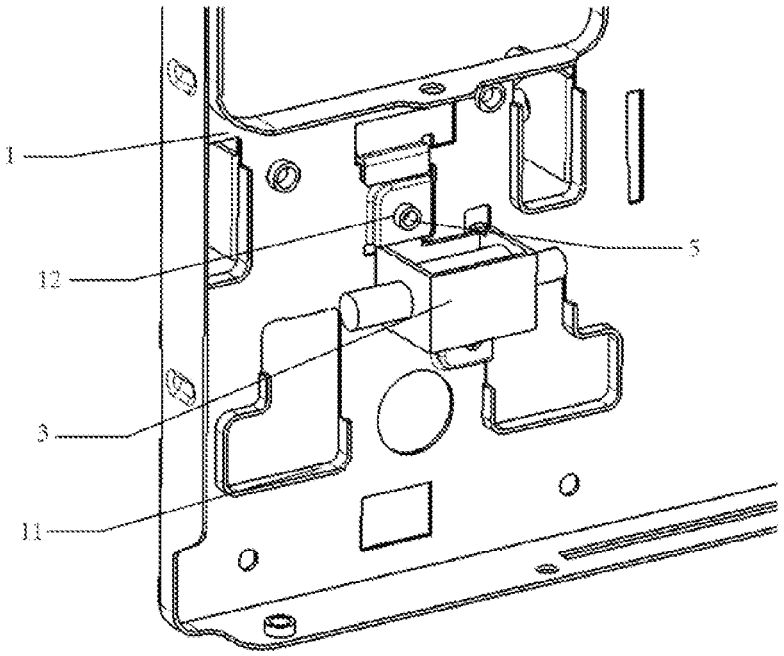
FIG. 1 is a schematic view of an electromagnet of a locking mechanism according to the first and third embodiments of the present invention.

1 front door panel; 11 opening; 12 first positioning threaded hole; 13 second positioning threaded hole; 2 lever; 21 protruding part; 211 pin shaft; 22 pressing part; 23 hole; 3 electromagnet; 31 push rod; 4 lever mounting plate; 41 through hole; 5 threaded member; 6 door; 61 control panel; 62 door opening button; 7 door opening member; 76 door hook

DETAILED DESCRIPTION

First Embodiment

A first embodiment of the present invention provides a locking mechanism provided on a front door panel 1 of a door 6 of a cooking machine and used for controlling opening and closing of a door 6. As shown in FIGS. 1, 2, 3 and 6, the locking mechanism includes a lever 2 which is mounted on the back surface of the front door panel 1 and at least a portion of which protrudes from an opening 11 provided on the front door panel 1 to the front surface of the front door panel 1; an electromagnet 3 which is mounted on the back surface of the front door panel 1 and may be in a locked or unlocked state with respect to the lever 2.

The locking of the door 6 of the cooking machine may be realized through the locking mechanism provided by the present invention. In brief, since the electromagnet 3 controls a locking member capable of limiting the movement of the lever 2, the locking of the door 6 is realized. The locking member is designed as long as the locking member may lock the movement of the lever 2, and the specific configuration is described in detail in the following embodiments.

Specifically, the electromagnet 3 is fixedly mounted on the front door panel 1, and the lever 2 is selectively locked or unlocked by controlling the magnetism of the electromagnet 3. When the locking mechanism needs to be turned on, the electromagnet 3 is energized to magnetize the electromagnet 3, so that the movement of the lever 2 is restricted by the locking member. Therefore, the lever 2 cannot trigger a door opening member 7 and the door 6 is locked. When the locking mechanism needs to be unlocked, the electromagnet 3 is de-energized, the magnetism generated by the electromagnet 3 is eliminated, the locking member is reset, and the restriction on the movement of the lever 2 is released. Therefore, the lever 2 may normally trigger the door opening member 7 and the door may be normally opened.

Compared with the prior art, the present invention achieves the locking of the door 6 of the cooking machine through the cooperation among the electromagnet 3, the front door panel 1 and the lever 2. Other members are controlled by the electromagnet 3, and when the locking mechanism is in the locked state, the lever 2 is prevented from moving, so that the door opening member 7 cannot be triggered by the lever 2 and the door 6 is locked. When the locking mechanism is in the unlocked state, the door opening operation may be normally performed.

Figure 3:
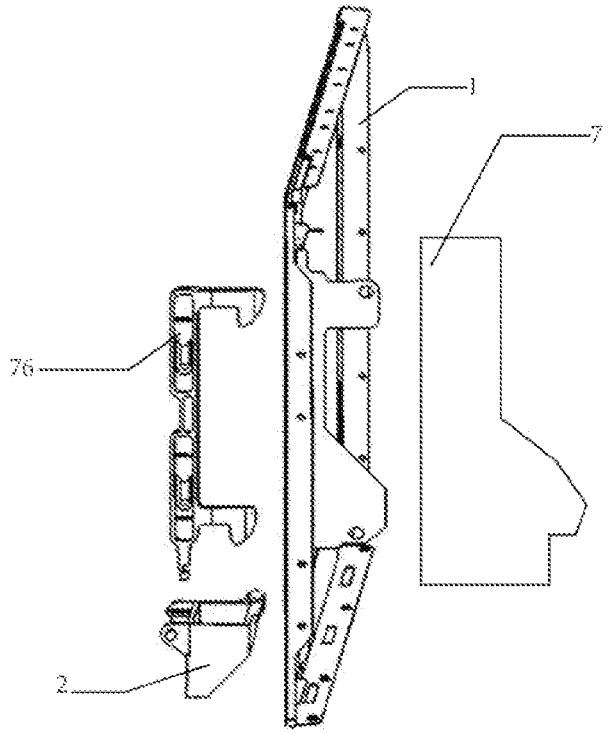
FIG. 3 is an exploded schematic view of a door opening member.

In general, as shown in FIG. 3, the door opening member 7 is provided on the front door panel 1. The lever 2 rotates after receiving a pressure transmitted thereto, and when the lever 2 rotates to a certain angle, the door opening member 7 is triggered, so that a door hook 76 originally engaged with the door opening member 7 is disengaged from the door opening member 7 and the door opening operation is completed.

It is worth mentioning that the control mechanism in which the electromagnet 3 is cooperated with the locking member is used to achieve the locking of the lever 2. Further, the door 6 of the cooking machine is locked when needed so as to improve the safety of users, especially children.

Second Embodiment

Figure 2:
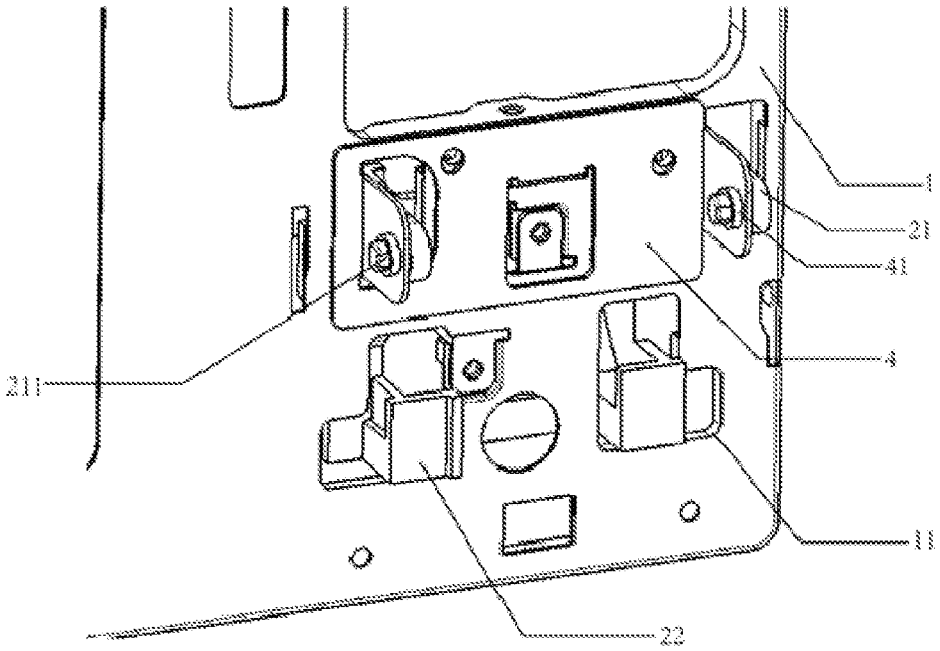
FIG. 2 is a schematic view of a lever and a lever mounting plate of a locking mechanism according to the first and second embodiments of the present invention.
Figure 4:
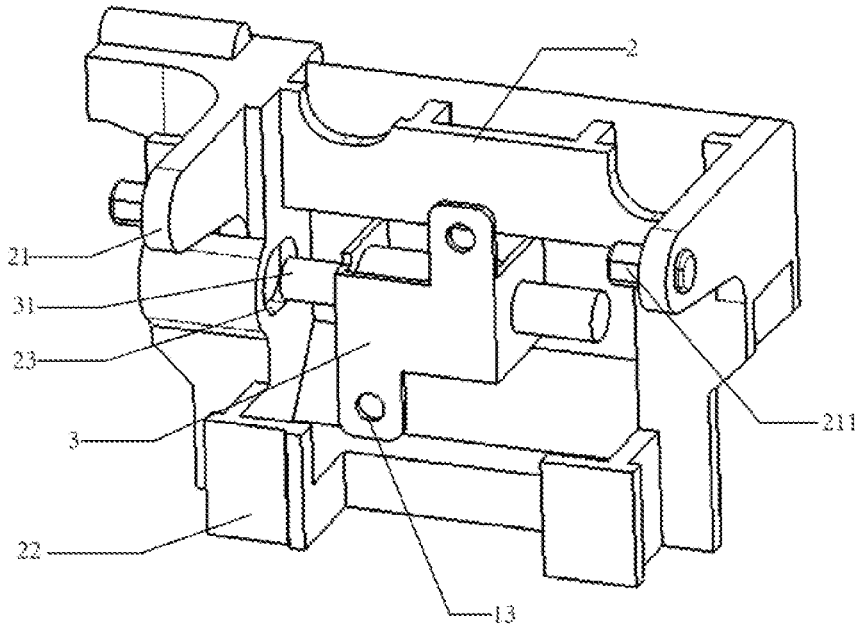
FIG. 4 is a schematic perspective view of a locking mechanism according to the second and third embodiments of the present invention when the locking mechanism is unlocked.
Figure 5:
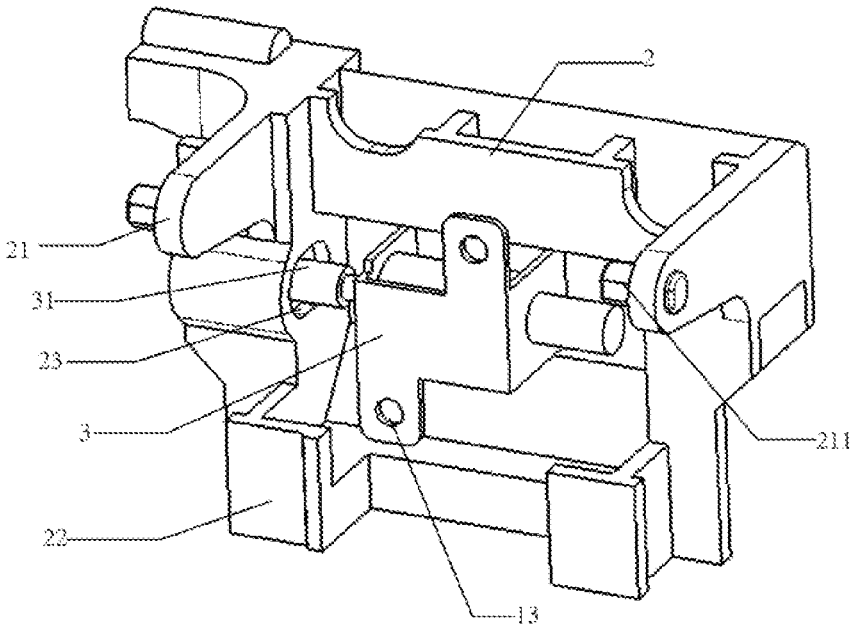
FIG. 5 is a schematic perspective view of the locking mechanism according to the second and third embodiments of the present invention when the locking mechanism is locked.

A second embodiment of the present invention provides a locking mechanism. The second embodiment is a further improvement of the first embodiment. The main improvement lies in that in the second embodiment of the present invention, as shown in FIGS. 2, 4 and 5, the locking mechanism further includes a lever mounting plate 4, wherein the lever mounting plate 4 is provided opposite to the lever 2 across the front door panel 1, and the lever 2 is pivotally mounted on the lever mounting plate 4.

The lever 2 is provided on the back surface of the front door panel 1, the lever mounting plate 4 is provided on the front surface of the front door panel 1, the lever 2 is positioned and mounted on the front door panel 1 by a mating member, and the lever mounting plate 4 is provided with a fulcrum of the lever 2. When the door 6 needs to be opened, an external force acts on the lever 2 to make the lever 2 rotate around a fixed axis. When the lever 2 rotates to a certain angle, the door opening member 7 may be triggered, so that the door hook 76 bounces up and the door is opened.

When the locking mechanism is locked, even if the external force acts on the lever 2 and the lever 2 tends to rotate, the lever 2 is blocked by the locking member, and the contact point between the locking member and the lever 2 corresponds to a second fulcrum of the lever 2. The second fulcrum provides a reaction force to the lever 2, so that the lever 2 cannot be pressed and the door 6 is locked.

The lever 2 is fixedly mounted on the front door panel 1 by the lever mounting plate 4. Moreover, since the level mounting panel 4 fixes the lever 2, the lever 2 may rotate around a fixed axis so as to trigger the door opening member 7 and control the opening of the door 6 of the cooking machine.

Preferably, in the embodiment, the portion of the lever 2 that protrudes from the opening 11 includes a protruding part 21 and a pressing part 22, wherein a pin shaft 211 is formed on the protruding part 21, and a through hole 41 through which the pin shaft 211 is inserted is provided on the lever mounting plate 4.

The opening 11 is provided on the front door panel 1 and the protruding part 21 and the pressing part 22 are protruded from the opening 11 so as to allow the lever 2 to be embedded in the front door panel 1. By such an embedded mode, the space occupied by the lever 2 is greatly reduced, and the overall volume of the locking mechanism is further reduced. In addition, the electromagnet 3 and the lever 2 may be more attached more tightly, so that a better locking effect is achieved. Since the pin shaft 211 on the protruding part 21 of the lever 2 cooperates with the through hole 41 and the pin shaft 211 is used as a fulcrum of the lever 2, the lever 2 may pivoted around the pin shaft 211.

The protruding part 21 protrudes from the opening 11 provided on the front door panel 1 and is rotatably fixed to the lever mounting plate 4 through the pin shaft 211. The pressing part 22 is used to transfer torque. When a pressure acts on the pressing part 22, the pressing part is pressed, and since the protruding part 21 of the lever 2 is hinged to the lever mounting plate 4 through the pin shaft 211, the lever 2 is rotated around a fixed axis and the door-opening member 7 is triggered.

In addition, in the embodiment, one end of the electromagnet 3 is provided with a telescopic push rod 31, and a portion of the lever 2 close to the push rod 31 is provided with a hole 23 that allows the push rod 31 to be inserted therein.

The size of the hole 23 is slightly larger than the size of the cross-section of the push rod 31. When the push rod 31 is inserted into the hole 23 and an external force acts on the lever 2, the lever 2 may only be slightly rotated and the door opening member 7 cannot be triggered. Moreover, the hole 23 slightly larger than the cross-section of the push rod 31 enables the push rod 31 to be still inserted into the hole 23 in different environments, so as to ensure a good locking effect. A certain gap is left around the pushing rod 31, which may effectively reduce the friction between the pushing rod 31 and the hole 23 and prolong the service life of the locking mechanism.

The electromagnet 3 may control the telescopic push rod 31. When the push rod 31 is inserted into the hole 23, the fixed-axis rotation of the lever 2 may be blocked and the pressing part 22 cannot be pressed, so that the door opening member 7 is prevented from being triggered and the door 6 is locked. The lever 2 may normally trigger the door opening member 7 when the push rod 31 is withdrawn from the hole 23.

More preferably, in the embodiment, the push rod 31 protrudes from the electromagnet 3 and is inserted into the hole 23 when the electromagnet 3 is turned on; the push rod 31 is retracted from the hole 23 when the electromagnet 3 is turned off.

Briefly, the locking member in the present invention may be the push rod 31. When the push rod 31 extends into the hole 23, the door 6 may be locked.

Specifically, the push rod 31 is in a contracted state when unlocked. When the locking mechanism is to be in the locked state, the electromagnet 3 is energized to generate magnetism, the pushing rod 31 protrudes under the action of magnetism and is inserted into the hole 23, so that locking is completed. At this time, even if the external force acts on the lever 2 and the lever 2 tends to rotate, the lever 2 is blocked by the push rod 31, and the contact point between the push rod 31 and the lever 2 becomes the second fulcrum of the lever 2. The second fulcrum provides a reaction force to the lever 2, so that the lever 2 cannot be pressed and the door 6 is locked.

In addition, in the present embodiment, a spring is further provided between the push rod 31 and the electromagnet 3. When the locking mechanism is in the locked state, the push rod 31 protrudes under the action of magnetism and the spring is stretched. When the electromagnet 3 is de-energized, the magnetism disappears and the push rod 31 is retracted under the action of the pulling force of the spring, so that the locked state is released.

The telescopic movement of the push rod 31 is flexibly controlled by the electromagnet 3. The electromagnet 3 generates magnetism under the action of the current and controls the push rod 31 to insert into the hole 23, and when the electromagnet is de-energized, the magnetism of the electromagnet disappears so as to realize locking or unlocking of the door 6.

Third Embodiment

A third embodiment of the present invention provides a locking mechanism. This embodiment is a further improvement of the first or second embodiment, and the main improvement lies in that in the third embodiment of the present invention, as shown in FIGS. 1, 4, 5 and 11, the front door panel 1 is provided with a first positioning threaded hole 12, the electromagnet 3 is provided with a second positioning threaded hole 13 corresponding to the first positioning threaded hole 12, and a threaded member 5 is passed through and fixed to the first positioning threaded hole 12 and the second positioning threaded hole 13, so that the electromagnet 3 is fixed to the front door panel 1.

When the locking mechanism locks the door 6, the push rod 31 plays a major role in preventing the lever 2 from rotating. Through cooperation between the threaded member 5 and each positioning threaded hole, the electromagnet 3 may be more firmly fixed to the front door panel 1. When an external force acts on the lever 2, since the electromagnet 3 is integral with the push rod 31, the electromagnet 3 is firmly mounted, which directly determines that the push rod 31 may perform a good locking effect.

Through the threaded member 5 and each positioning threaded hole, the electromagnet 3 may be more firmly positioned and fixed to the front door panel 1. When the locking mechanism is locked, the push rod 31 may be firmly inserted in the hole 23 even if the pressing part 22 is pressed, so that a good locking effect is achieved.

Fourth Embodiment

Figure 6:
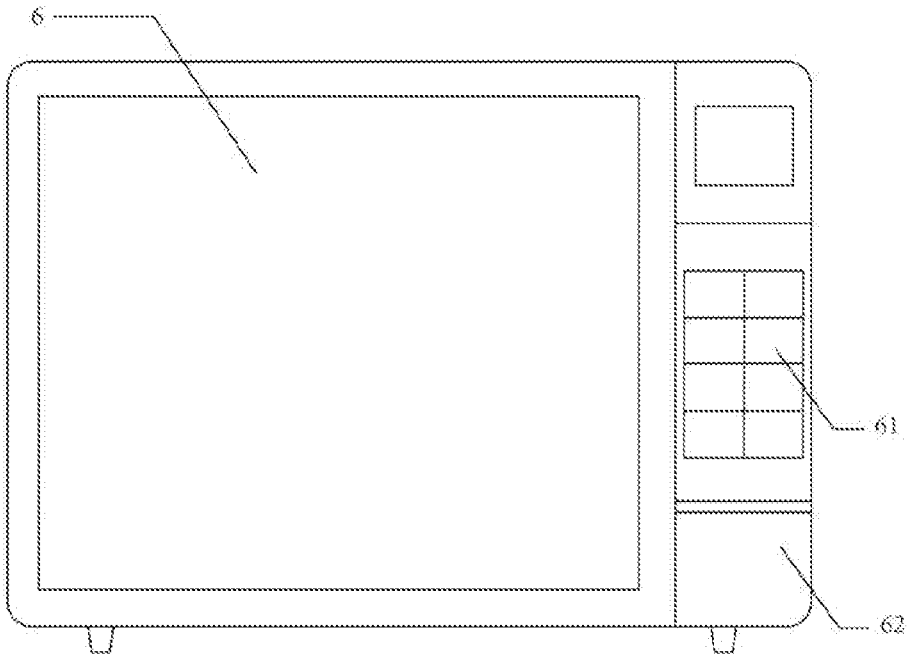
FIG. 6 is a schematic front view of a cooking machine according to the fourth embodiment of the present invention.

A fourth embodiment of the present invention provides a cooking machine. As shown in FIG. 6, the above-described locking mechanism is provided on the cooking machine, and a control panel 61 is provided on the front door panel 1 of the door 6.

The locking mechanism is mounted on a position corresponding to the door opening button 62 of the cooking machine and communicatively connected to a control mechanism (not shown) of the cooking machine. When using the cooking machine, the user may select whether to enable the locking mechanism according to his needs.

In the embodiment, the locking mechanism is triggered through pressing a single button or a button combination, so that the door 6 is kept in a locked or an unlocked state.

The locking mechanism is controlled by pressing a single button or the existing button combination, and there is no need to additionally provide a button for controlling the locking mechanism, so that the size of the control panel 61 may be set in a certain range and the overall size of the cooking machine may be controlled. More importantly, using the button combination increases the difficulty for children to unlock and open the door 6 and keeps the door 6 in the locked state, so that the risk of children being scalded is lowered.

In brief, enabling or disabling the locking mechanism may be achieved by setting the buttons on the control panel 61. After the locking mechanism is enabled, the cooking machine may lock the door 6 in time when the cooking machine is in the operation state; after the operation is finished, the door 6 may be unlocked by manual operating the button, and the door 6 may be unlocked in time by the control mechanism. After the locking mechanism is disabled, the door 6 of the cooking machine is used in the same way as the existing food processor.

Figure 12:
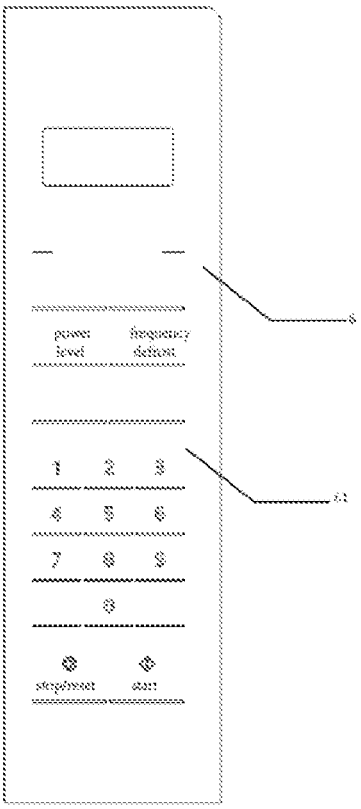
FIG. 12 is a schematic view of a control panel of the cooking machine according to the fourth embodiment of the present invention.

Specifically, as shown in FIG. 12, enabling or disabling the locking mechanism may be selected through a way of pressing a "inverter turbo defrost" button, a "stop/reset" button and a "start" button sequentially. When the locking mechanism is enabled, the way of operating the button to unlock the door 6 usually includes first pressing the "inverter turbo defrost" button and then pressing a "power level" button. Of course, the way may also be designed as pressing buttons different from the above-mentioned buttons to enable or disable the locking mechanism as required. For example, the locking mechanism may be enabled by only pressing a single button, for example, pressing the "inverter turbo defrost" button over a specified time, and the selection of a single button and the setting condition (e.g., time) of the single button may be changed according to actual needs. In addition, in the above description, the locking mechanism is triggered by sequentially pressing a combination of different buttons. Of course, the timing of pressing the buttons may also be changed. For example, the locking mechanism is triggered by simultaneously pressing different buttons.

Further, in the embodiment, in the steps of pressing a combination of different buttons, the time interval between the actions of pressing different buttons in the button combination is within a specified range.

For example, when the locking mechanism is unlocked, the time interval for pressing different buttons may be set between 60 milliseconds and 10 seconds, preferably between 100 milliseconds and 300 milliseconds. If the user presses the "inverter turbo defrost" button and then presses the "power level" within 100 milliseconds, the locking mechanism cannot be unlocked. If the user presses the "inverter turbo defrost" button, the cooking machine performs the step of inverter turbo defrost after 300 milliseconds, and the locking mechanism cannot be unlocked by pressing the "power level" button at this time. The unlocking operation may be completed only by pressing the "power level" button after pressing the "inverter turbo defrost" button within 100 milliseconds to 300 milliseconds. Similarly, when the locking mechanism performs the locking operation, a corresponding time interval may also be set.

The specified range of the time interval between two adjacent push operations is set and the locking mechanism may only be unlocked within the time interval, so that the possibility that the locking mechanism is locked or unlocked due to erroneous operations such as a slip of the finger by the user may be effectively reduced.

Compared with the prior art, the cooking machine provided by the present invention achieves the locking of the door 6 of the cooking machine through providing the above-described locking mechanism. After the cooking machine finishes the operation, the locking mechanism is unlocked so as to open the door 6 of the cooking machine. Children are prevented from being scalded when opening the cooking machine in a way of locking the door 6 of the locking mechanism.

Fifth Embodiment

Figure 7:
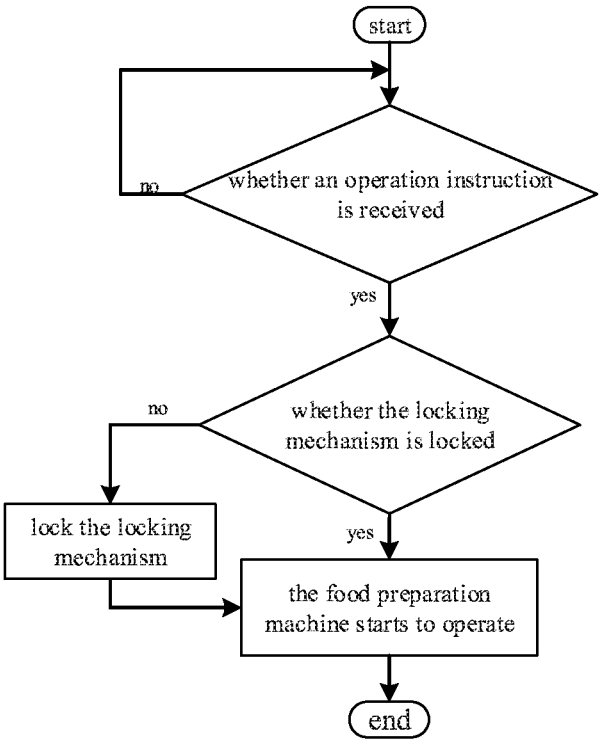
FIG. 7 is a schematic view of a workflow of locking the locking mechanism in a door opening control method according to the fifth embodiment of the present invention.
Figure 8:
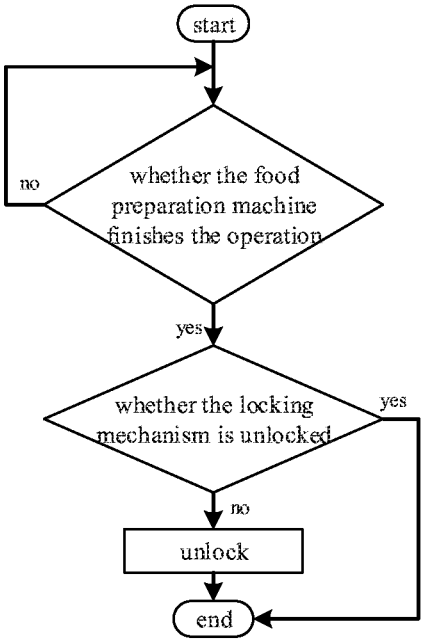
FIG. 8 is a schematic view of a workflow of unlocking the locking mechanism in the door opening control method according to the fifth embodiment of the present invention.

As shown in FIGS. 7 and 8, a fifth embodiment of the present invention provides a door opening control method for performing door opening and closing control of the door 6 of the cooking machine. When the cooking machine is in an operation state, the locking mechanism keeps the door 6 in the locked state, and after the operation of the cooking machine is completed, the locking mechanism keeps the door 6 in the unlocked state.

In short, the door opening control method provided by the present invention determines the operation steps of the locking mechanism by the control mechanism and finally determines the action to be performed by the locking mechanism and transmits an action instruction to the locking mechanism in the form of electrical signals.

Specifically, when the locking mechanism is enabled, the automatic control steps of the door opening control method are as follows:

when the cooking machine is energized, the control mechanism determines whether the cooking machine has received an instruction to enter the operation state;

if it is determined that the cooking machine has not received the instruction to enter the operation state, the control mechanism determines whether the cooking machine has entered the operation state again;

if it is determined that the cooking machine has received the instruction to enter the operation state, the control mechanism determines whether the locking mechanism is in a locked state;

if it is determined that the locking mechanism is in the locked state, the cooking machine starts to operate; and if it is determined that the locking mechanism is not in the locked state, the control mechanism turns on the circuit connection of the electromagnet 3 and drives the push rod 31 to insert into the hole 23 to complete the locking of the door 6 by the locking mechanism.

When the cooking machine finishes the operation, the locking of the door 6 by the locking mechanism is released by the user's operation of the buttons on the control panel 61.

The locking of the locking mechanism may also be automatically released by the control mechanism.

The steps for the control mechanism to control the locking mechanism to automatically unlock are as follows:

the control mechanism determines whether the cooking machine has finished the operation;

if it is determined that the cooking machine is still in the operation state, the control mechanism determines whether the cooking machine has finished the operation again;

if it is determined that the cooking machine has finished the operation, the control mechanism further determines whether the locking mechanism is in the unlocked state;

if it is determined that the locking mechanism is in the unlocked state, the cooking machine no longer operates the locking mechanism; and if it is determined that the locking mechanism is still in the locked state, the control mechanism turns off the circuit connection of the electromagnet 3, the push rod 31 is retracted from the hole 23 as the magnetism of the electromagnet 3 disappears, and the locking of the door 6 by the locking mechanism is released.

Compared with the prior art, through the door opening control method provided by the present invention, the electromagnet 3 may be energized to control the locking of the door 6 when the cooking machine is in operation, and the electromagnet 3 may be de-energized to control the unlocking of the locking mechanism after the cooking machine finishes the operation. Through the door opening control method provided by the present invention, the real-time control of the door 6 may be realized so as to better ensure the safety of the user.

Sixth Embodiment

Figure 9:
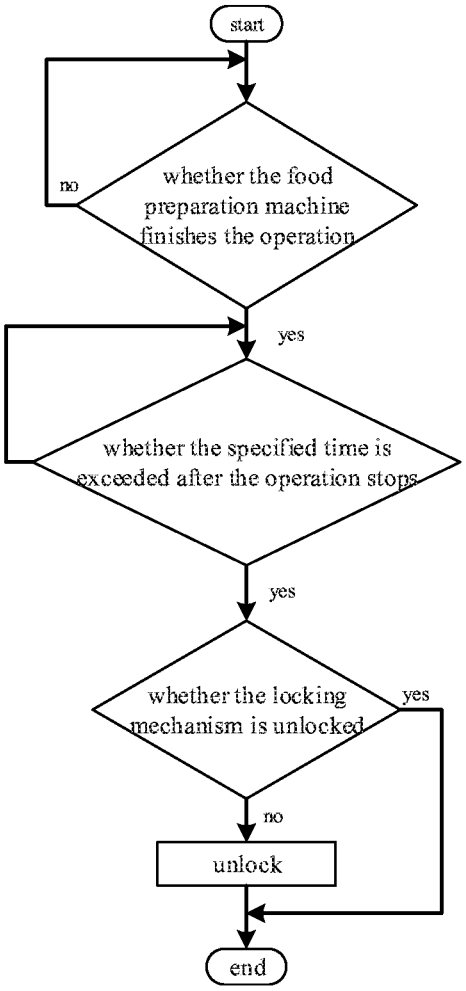
FIG. 9 is a schematic view of a workflow of unlocking the locking mechanism in a door opening control method according to the sixth embodiment of the present invention.

A sixth embodiment of the present invention provides a door opening control method. This embodiment is a further improvement of the fifth embodiment and a main improvement lies in that in the sixth embodiment of the present invention, as shown in FIG. 9, the locking mechanism is operated to keep the door 6 in the unlocked state after the cooking machine finishes the operation and over a specified time.

In the door opening control method of the present embodiment, the control method for automatically locking the locking mechanism is basically the same as that provided in the fifth embodiment, but the user may preset a predetermined period of time as the specified time to unlock the cooking machine. Take the specified time duration as 10 minutes as an example:

the control mechanism determines whether the cooking machine has finished the operation;

if it is determined that the cooking machine is still in the operation state, the control mechanism determines whether the cooking machine has finished the operation again;

if it is determined that the cooking machine has finished the operation, the control mechanism further compares the time after the cooking machine has finished the operation with the preset specified time, if the time after the cooking machine has finished the operation is less than the preset specified time, the two times are compared again;

if the time after the cooking machine has finished the operation is more than or equal to the preset specified time, it is determined whether the locking mechanism is in the unlocked state;

if it is determined that the locking mechanism is in the unlocked state, the cooking machine no longer operates the locking mechanism; and if it is determined that the locking mechanism is still in the locked state, the control mechanism turns off the circuit connection of the electromagnet 3, the push rod 31 is retracted from the hole 23 as the magnetism of the electromagnet 3 disappears, and the locking of the door 6 by the locking mechanism is released.

By setting a corresponding program, the cooking machine cannot be opened during operation, so that the locking mechanism keeps in the locked state during the operation of cooking machine. By presetting the specified time, the locking of the door 6 of the cooking machine is ensured, so that the user is prevented from being scalded when the cooking machine is used and the food is still in high temperature.

Seventh Embodiment

Figure 10:
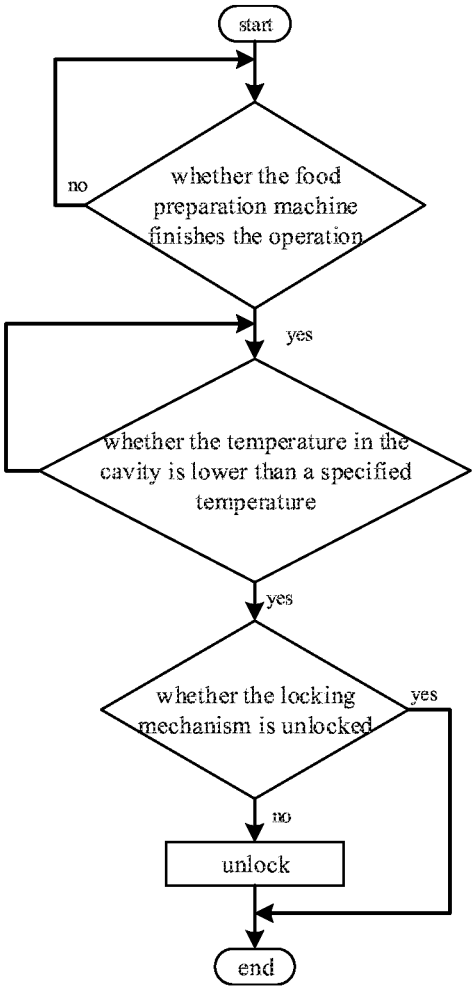
FIG. 10 is a schematic view of a workflow of unlocking the locking mechanism in a door opening control method according to the seventh embodiment of the present invention.
Figure 11:
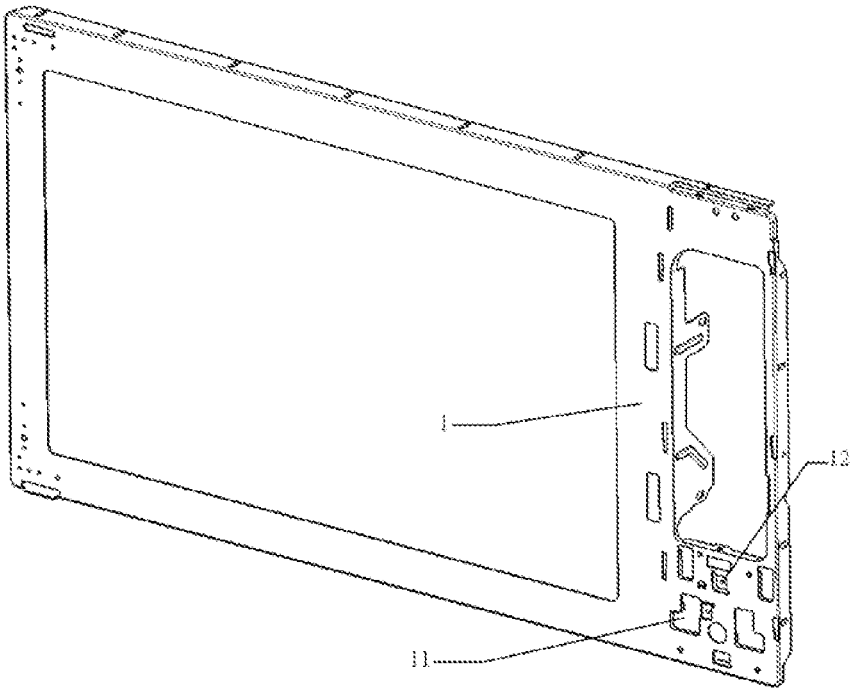
FIG. 11 is a schematic perspective view of a front door panel of the locking mechanism according to the third embodiment.

A seventh embodiment of the present invention also provides a door opening control method. This embodiment is different from the sixth embodiment and the main difference lies in that in the sixth embodiment of the present invention, when the cooking machine finishes the operation, the control mechanism unlocks the locking mechanism of the door 6 by using the specified time as a determination basis, while in the seventh embodiment, as shown in FIG. 10, the locking mechanism is used to make the door 6 in the unlocked state when the temperature of the cooking machine is below a specified temperature.

In a cavity of the cooking machine mentioned in the embodiment, a temperature sensing device is further provided and communicatively connected to the control mechanism. Preferably, the temperature in the cooking machine may be measured using an infrared temperature sensing device. The control method of automatic locking the locking mechanism is basically the same as that provided in the fifth embodiment, and the locking and unlocking of the locking mechanism is further controlled by comparing the measured temperature with a predetermined prescribed temperature.

Specifically, the door opening control method in the embodiment is as follows:

the control mechanism determines whether the cooking machine has finished the operation;

if it is determined that the cooking machine is still in the operation state, the control mechanism determines whether the cooking machine has finished the operation again;

if it is determined that the cooking machine has finished the operation, the control mechanism further compares the temperature in the cavity after the cooking machine has finished the operation with the specified temperature;

if the temperature in the cavity after the cooking machine finishes the operation is higher than the specified temperature, the two temperature values are compared again;

if the temperature in the cavity after the cooking machine finishes the operation is equal to or lower than the specified temperature, it is determined whether the locking mechanism is in the unlocked state;

if it is determined that the locking mechanism is in the unlocked state, the cooking machine no longer operates the locking mechanism; and if it is determined that the locking mechanism is still in the locked state, the control mechanism turns off the circuit connection of the electromagnet 3, the push rod 31 is retracted from the hole 23 as the magnetism of the electromagnet 3 disappears, and the locking of the door 6 by the locking mechanism is released.

The cooking machine actively measures the temperature after the cooking machine finishes the operation, and when the temperature is measured to be lower than the specified temperature, the locking mechanism is unlocked. Not only may the flavor of the food processed by the cooking machine be ensured, but also lower age users may be protected.

For those skilled in the art, various steps of the above-described control method may be deleted or the order of the steps may be adjusted as needed within the scope of the technical idea of the present invention.

It is to be understood by those of ordinary skill in the art that in the above-described embodiments, many technical details are proposed in order to provide the reader with a better understanding of the present application. However, the technical solutions claimed in the claims of the present application may basically be implemented without these technical details and various changes and modifications based on the above-described embodiments. Thus, in the practical application, various changes may be made in the form and details of the above-described embodiments without departing from the spirit and scope of the invention.

The invention claimed is:

1. A locking mechanism provided on a front door panel of a door for a cooking machine and used for controlling opening and closing of the door, the locking mechanism comprising:

a lever which is mounted on a back surface of the front door panel and at least a portion of which protrudes from an opening provided on the front door panel to a front surface of the front door panel;

a lever mounting plate provided opposite to the lever across the front door panel, wherein:

the lever is rotatably mounted on the lever mounting plate;

the portion of the lever protruding from the opening provided on the front door panel includes a protruding part and a pressing part;

a pin shaft is formed on the protruding part, and a through hole through which the pin shaft is inserted is provided on the lever mounting plate; and the pressing part is configured to receive pressure, drive the lever to rotate, and trigger the door to open; and an electromagnet which is mounted on the back surface of the front door panel and is operable to lock or unlock the rotation of the lever, wherein one end of the electromagnet is provided with a telescopic push rod, and a portion of the lever close to the push rod is provided with a hole that allows the push rod to be inserted therein.

2. The locking mechanism according to claim 1, wherein:

the push rod protrudes from the electromagnet and is inserted into the hole when the electromagnet is turned on; the push rod is retracted from the hole when the electromagnet is turned off.

3. The locking mechanism according to claim 1, wherein:

the front door panel is provided with a first positioning threaded hole, the electromagnet is provided with a second positioning threaded hole corresponding to the first positioning threaded hole, and a threaded member is passed through and fixed to the first positioning threaded hole and the second positioning threaded hole, so that the electromagnet is fixed to the front door panel.

4. A cooking machine comprising:

a door having a front door panel with a front surface and a back surface;

a locking mechanism provided on the front door panel, which controls opening and closing of the door, the locking mechanism comprising:

a lever which is mounted on the back surface of the front door panel and at least a portion of which protrudes from an opening provided on the front door panel to the front surface of the front door panel;

a lever mounting plate provided opposite to the lever across the front door panel, wherein:

the lever is rotatably mounted on the lever mounting plate;

the portion of the lever protruding from the opening provided on the front door panel includes a protruding part and a pressing part;

a pin shaft is formed on the protruding part, and a through hole through which the pin shaft is inserted is provided on the lever mounting plate; and the pressing part is configured to receive pressure, drive the lever to rotate, and trigger the door to open; and an electromagnet which is mounted on the back surface of the front door panel and is operable to lock or unlock the rotation of the lever, wherein one end of the electromagnet is provided with a telescopic push rod, and a portion of the lever close to the push rod is provided with a hole that allows the push rod to be inserted therein; and a control panel provided on the front door panel of the door of the cooking machine.

5. A door opening control method comprising:

operating a cooking machine in an operation state, the cooking machine comprising:

a door having a front door panel with a front surface and a back surface;

a locking mechanism provided on the front door panel, which controls opening and closing of the door, the locking mechanism comprising:

a lever which is mounted on the back surface of the front door panel and at least a portion of which protrudes from an opening provided on the front door panel to the front surface of the front door panel;

a lever mounting plate provided opposite to the lever across the front door panel, wherein:

the lever is rotatably mounted on the lever mounting plate;

the portion of the lever protruding from the opening provided on the front door panel includes a protruding part and a pressing part;

a pin shaft is formed on the protruding part, and a through hole through which the pin shaft is inserted is provided on the lever mounting plate; and the pressing part is configured to receive pressure, drive the lever to rotate, and trigger the door to open; and an electromagnet which is mounted on the back surface of the front door panel and is operable to lock or unlock the rotation of the lever, wherein one end of the electromagnet is provided with a telescopic push rod, and a portion of the lever close to the push rod is provided with a hole that allows the push rod to be inserted therein; and a control panel provided on the front door panel of the door of the cooking machine; and performing door opening and closing control on the door of the cooking machine, wherein when the cooking machine is in the operation state, the locking mechanism keeps the door in a locked state by energizing the electromagnet such that the push rod is inserted in the hole in the lever, and after the operation state of the cooking machine is completed, the locking mechanism keeps the door in an unlocked state by de-energizing the electromagnet such that the push rod is retracted from the hole in the lever.

6. The door opening control method according to claim 5, wherein:

the locking mechanism is triggered through pressing a single button or a button combination, so that the door is kept in a locked or an unlocked state.

7. The door opening control method according to claim 6, wherein:

the locking mechanism is triggered through pressing a button combination and a time interval between actions of pressing different buttons in the button combination is within a specified range.

* * * * *